United States Patent [19]

Zusman

[11] 4,281,486

[45] * Aug. 4, 1981

[54] CANTILEVERED CROSS TRUSS CONSTRUCTION

[76] Inventor: Bertram Zusman, 4112 Montecello Blvd., Youngstown, Ohio 44505

[ * ] Notice: The portion of the term of this patent subsequent to Mar. 25, 1997, has been disclaimed.

[21] Appl. No.: 103,613

[22] Filed: Dec. 14, 1979

[51] Int. Cl.[3] ..... E04B 1/34

[52] U.S. Cl. ..... 52/73; 52/668; 52/693

[58] Field of Search ..... 52/73, 693, 668, 664, 52/643, 666

[56] References Cited

U.S. PATENT DOCUMENTS

| | | | |
|---|---|---|---|
| 1,911,018 | 5/1933 | Goeltz | 52/648 |
| 3,477,189 | 11/1969 | Merson | 52/648 |
| 3,755,973 | 9/1973 | Rader | 52/73 |
| 3,927,950 | 12/1975 | Herrmann et al. | 52/668 X |
| 4,194,326 | 3/1980 | Zusman | 52/693 X |

*Primary Examiner*—Carl D. Friedman

*Attorney, Agent, or Firm*—Webster B. Harpman

[57] ABSTRACT

A cantilevered cross truss construction provides a load supporting structure through the interlocking of the trusses, said trusses having continuous top and bottom chord members, the bottom chord of one of which is adapted to be cut in the field, said cut truss can be positioned over the other truss forming a superior load supporting truss construction.

4 Claims, 5 Drawing Figures

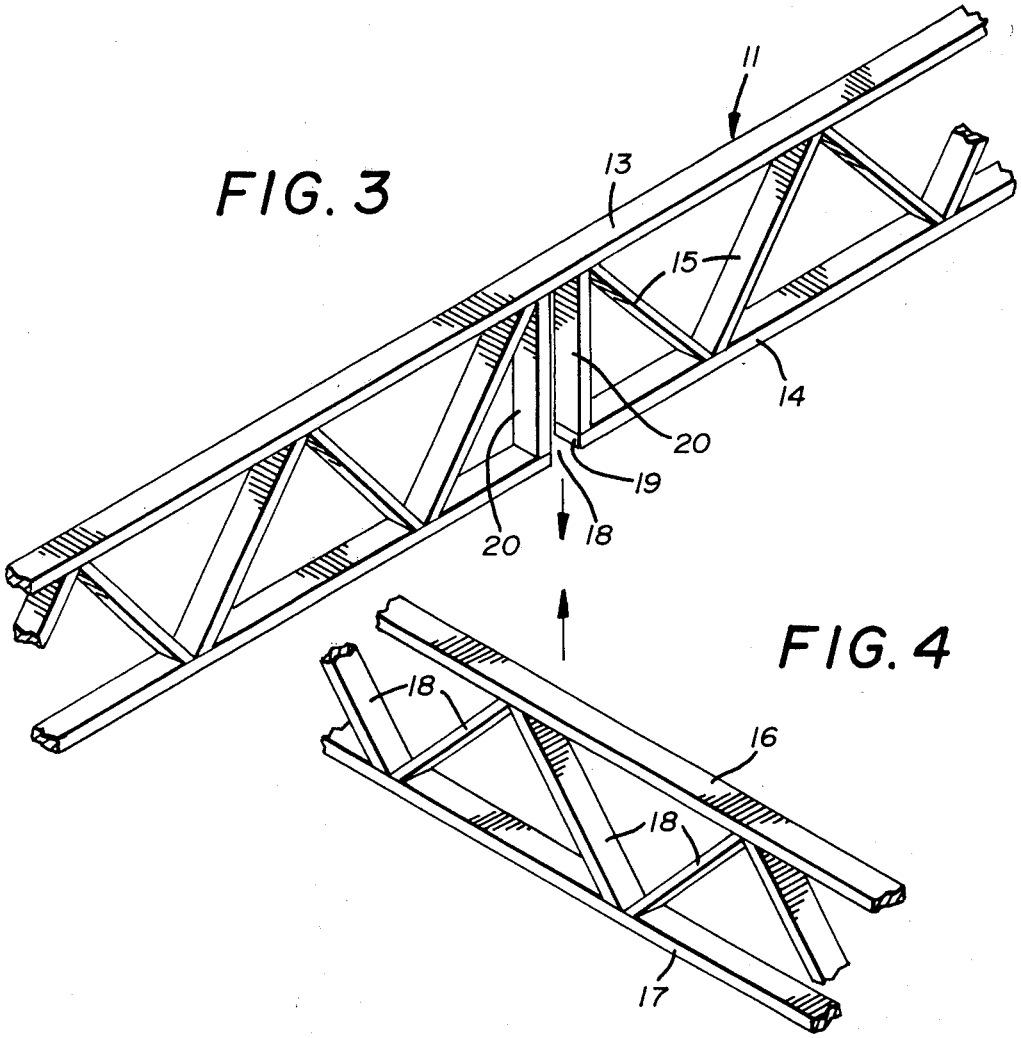
FIG. 3
FIG. 4
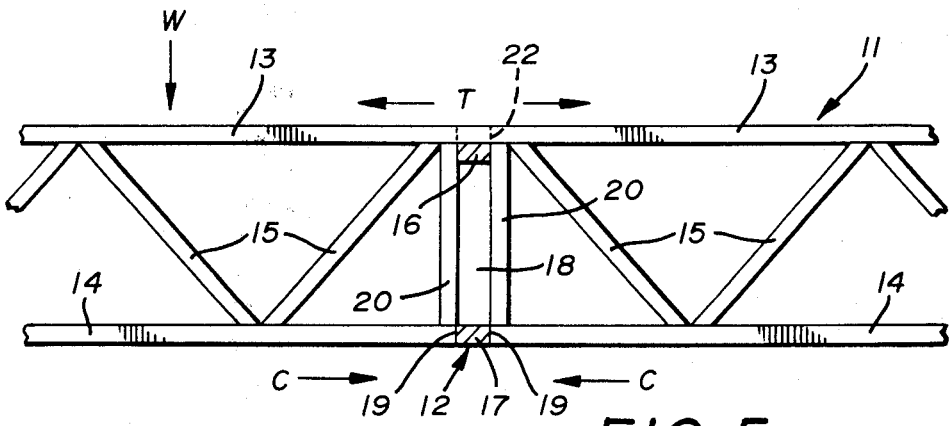
FIG. 5

CANTILEVERED CROSS TRUSS CONSTRUCTION

BACKGROUND OF THE INVENTION (1) Field of the Invention:

This invention relates to load supporting structures of a truss configuration.

(2) Description of the Prior Art:

Prior structures of this type have utilized truss construction for integral load supporting configurations. See for example U.S. Pat. Nos. 3,410,036; 3,477,189 and 4,156,995.

In U.S. Pat. No. 3,410,036 a multi-purpose roof structure is disclosed formed of an elongated bridge member with chord members all of the same height supported by hydraulic means.

In the present invention a cross truss system is disclosed having pairs of truss members of different heights, one of which is notched on site in such a manner as to interlock one within the other.

In U.S. Pat. No. 3,477,189 a load supporting structure is disclosed comprising two series of interlocking trusses wherein one truss member has a series of gaps in the upper chord so that the other truss member can be lowered into it with one truss member having a lesser height than the other.

In the present invention, two truss members of different heights are engaged at right angles to one another achieving a self-supporting cantilevered structure of cross shape.

U.S. Pat. No. 4,156,995, applicant's earlier patent on a crossed truss construction, shows truss members with continuous top and bottom chords wherein one truss member is placed through the other.

Applicant's present invention uses truss members of different heights with continuous top and bottom chords, one of which can be notched on site wherein the notched truss may be placed over the other with an additional spacing member placed on said other truss to achieve a uniform surface area height.

SUMMARY OF THE INVENTION

A cantilevered cross truss construction wherein a series of two truss members of different heights are placed at right angles to one another with a notch in the lower chord of one truss allowing it to be placed over the other truss forming a self supporting truss construction whose ends extend beyond the crossed areas.

DESCRIPTION OF THE DRAWINGS

FIG. 3 is a perspective view of one of the truss members of the construction;

FIG. 4 is a perspective view of the other one of the truss members; and

FIG. 5 is an partial cross section on lines 5—5 of FIG. 1.

DESCRIPTION OF THE PREFERRED EMBODIMENT

Figure 2:
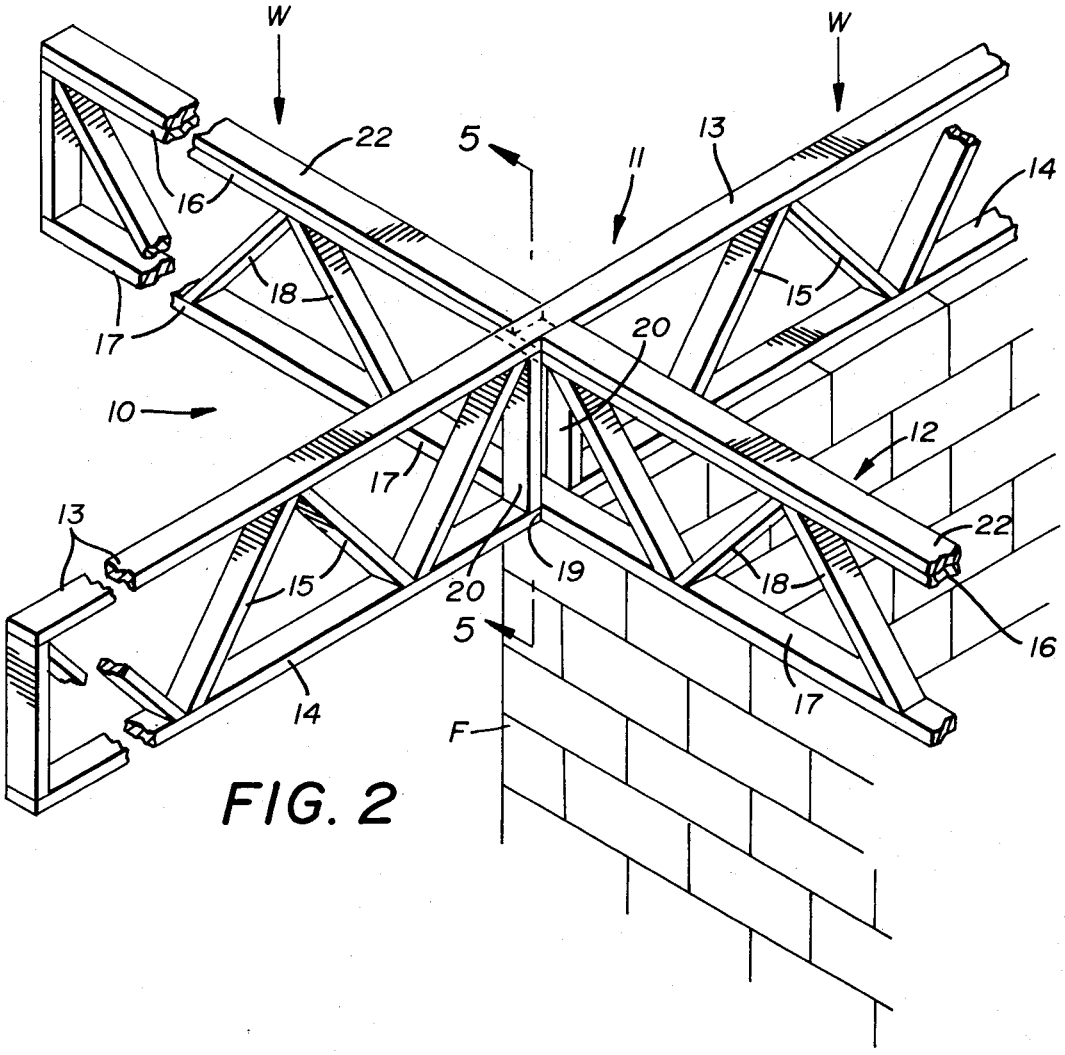
FIG. 2 is an enlarged perspective view of a portion of the truss construction.
Figure 1:
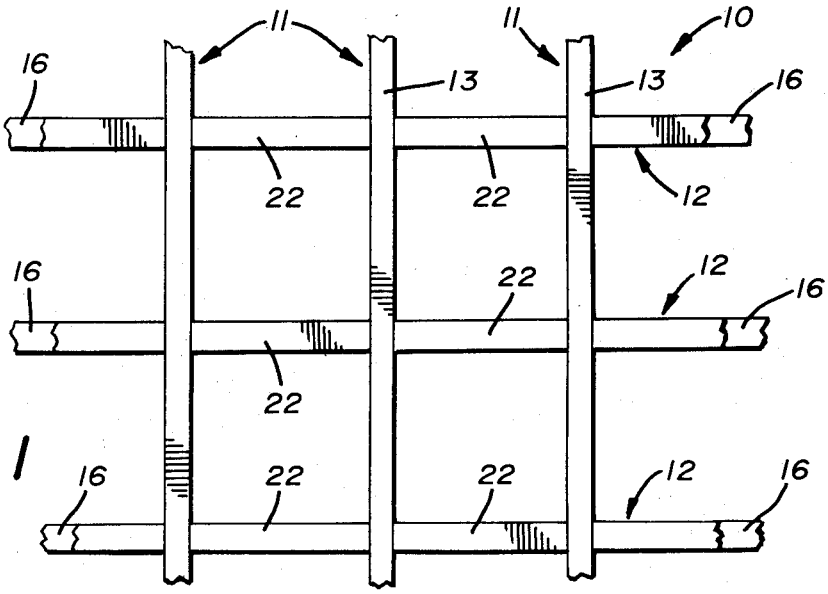
FIG. 1 is a top plan view of the cantilevered cross truss construction.

As seen in FIGS. 1 and 2 of the drawings, a cantilevered cross truss construction 10 is disclosed comprising truss members 11 and 12 crossing at right angles to one another and positioned on a foundation wall F.

In FIG. 2 of the drawings, an enlarged detail of the cross truss construction is illustrated wherein a first truss member 11 has upper and lower chords 13 and 14 with a plurality of chord connecting webs 15 that are positioned between the chords 13 and 14 in an angular end to end pattern. A second truss member 12 has upper and lower chords 16 and 17 with a plurality of chord connecting webs 18 that are positioned between the chords 16 and 17 in an end to end angular pattern.

Referring now to FIGS. 3 and 4 of the drawings, it will be seen that the lower chord 14 of the first truss 11 is adapted to be notched as at 19 by cutting away a portion of the lower chord 14 and that the notch 19 as formed is also defined by a pair of spaced vertical chord connecting members 20. The chords 16 and 17 of the second truss 12 are unbroken and the area of cross truss engagement is against the sides thereof and against the sides of the webs 18. Fasteners are used to secure the assembled crossed trusses to one another.

In FIG. 5 of the drawings, the truss members 11 and 12 are seen in cross section in assembled cross pattern and the notch 19 is engaged over the lower chord 17 of the truss 12 with the upper chord 16 positioned between the members 20 and below the upper chord 13 of the truss 11. The cross truss construction has increased strength due to the interlocking of the truss members 11 and 12 wherein weight as indicated by the arrow W in FIG. 5 of the drawings, acts to tension the truss 11 as indicated by a tension arrow T and compression arrows C, and the same effects apply to the truss 12.

Referring now to FIG. 2 of the drawings, the truss 12 is illustrated with a spacing member 22 positioned on the upper chord 16 and extending on either side of the upper chord 13 of the truss 11 providing an even top surface of the crossed trusses. Weight indicated by the arrows W acts to tension the upper chords 13 and 16 and compress the lower chords 14 and 17.

As will be seen the load factor of the crossed truss construction is thus increased and a new and novel truss construction is disclosed which can be simply and inexpensively built to form a structure allowing greater utilization of building materials and a shorter building time. The structure is particularly useful in pedestal homes and the like wherein the cantilever effect is highly desirable.

Although but one embodiment of the present invention has been illustrated and described, it will be apparent to those skilled in the art that various changes and modifications may be made therein without departing from the spirit of the invention and having thus described my invention what I claim is:

1. A cantilevered cross truss construction comprising several pairs of crossed horizontally disposed truss members, each truss member including vertically spaced top and bottom chord members and interconnecting web members, one of each pair of truss members being of a greater height than the other, a first one of each of said pairs of truss members having notches in its lower chord with said web members arranged to enable said first one of each of said pairs of truss members to be positioned over a second one of each of said pairs of truss members, the notches in the lower chord of said first one of each of said pairs of truss members being engaged over portions of the lower chord in the second one of each of said pairs of truss members and a spacer on said upper chord of the second one of each of said pairs of truss members whereby the top and bottom surfaces of each of said pairs of truss members lie on common vertically spaced horizontal planes.

2. The cantilevered cross truss construction of claim 1 wherein the top and bottom chord members and interconnecting web members are single sections of material.

3. The cantilevered cross truss construction of claim 1 and wherein most of said interconnecting web members are angularly disposed between the top and bottom chord members and some of said web members are arranged in horizontally spaced vertical pairs registering with said notches.

4. The cantilevered cross truss construction of claim 1 wherein said chord members and interconnecting web members are wood.

* * * * *